US012722199B2

(12) United States Patent
Kadlecek et al.

(10) Patent No.: US 12,722,199 B2
(45) Date of Patent: Sep. 1, 2026

(54) POWER TOOL HAVING FASTENER GRIPPING PORTION POSITION TRACKING FUNCTIONALITY

(71) Applicant: BLACK & DECKER INC., New Britain, CT (US)

(72) Inventors: Daniel Kadlecek, Bischofscheim (DE); Benjamin Schmidt, Mainz (DE); Fugen Qin, Baltimore, MD (US)

(73) Assignee: BLACK & DECKER INC.

( * ) Notice: Subject to any disclaimer, the term of this patent is extended or adjusted under 35 U.S.C. 154(b) by 0 days.

(21) Appl. No.: 18/467,986

(22) Filed: Sep. 15, 2023

(65) Prior Publication Data

US 2024/0091846 A1 Mar. 21, 2024

Related U.S. Application Data

(63) Continuation of application No. 17/932,324, filed on Sep. 15, 2022.

(51) Int. Cl.
*B21J 15/28* (2006.01)
*B21J 15/04* (2006.01)
(Continued)

(52) U.S. Cl.
CPC ..... *B21J 15/28* (2013.01); *B21J 15/043* (2013.01); *B21J 15/105* (2013.01); *B21J 15/26* (2013.01)

(58) Field of Classification Search
CPC ..... B21J 15/022; B21J 15/043–045; B21J 15/105; B21J 15/12; B21J 15/16; B21J 15/26; B21J 15/28–285
See application file for complete search history.

(56) References Cited

U.S. PATENT DOCUMENTS 4,676,421 A 6/1987 Swanstrom
6,655,473 B1 * 12/2003 Chi ..... B25F 5/001 173/216

(Continued)

FOREIGN PATENT DOCUMENTS

DE 102014208841 A1 11/2015
EP 2374558 B1 8/2016

(Continued)

OTHER PUBLICATIONS

Translation of WO2019049910 (Year: 2019).*

(Continued)

*Primary Examiner* — Matthew P Travers
(74) *Attorney, Agent, or Firm* — Jordan IP Law, LLC; Todd A. Vaughn

(57) ABSTRACT

A power tool comprising: a motor; a fastener gripping portion operatively coupled to the motor for causing movement of the fastener gripping portion between a home position and a retracted position to set a fastener; a home position sensor for generating output indicative that the fastener gripping portion has reached the home position during a reset stage of operation in which the fastener gripping portion is moved towards the home position; and a controller for receiving motor turn information indicative of the number of turns of the motor and for monitoring the position of the fastener gripping portion based on the motor turn information and the output generated by the home position sensor.

20 Claims, 9 Drawing Sheets

(51) Int. Cl.
*B21J 15/10* (2006.01)
*B21J 15/26* (2006.01)

(56) References Cited

U.S. PATENT DOCUMENTS

| | | | | |
|---|---|---|---|---|
| 6,929,074 | B1 * | 8/2005 | Lai | B25B 21/00 173/217 |
| 8,015,699 | B2 | 9/2011 | Fulbright | |
| 8,109,123 | B2 | 2/2012 | Chen | |
| 9,968,988 | B2 | 5/2018 | Masugata | |
| 10,232,429 | B1 * | 3/2019 | Lin | G01R 33/072 |
| 11,065,674 | B2 | 7/2021 | Kawai et al. | |
| 2007/0295779 | A1 | 12/2007 | Fulbright | |
| 2010/0275424 | A1 | 11/2010 | Masugata | |
| 2015/0336159 | A1 | 11/2015 | Gaertner et al. | |
| 2018/0126446 | A1 | 5/2018 | Mori | |
| 2019/0247913 | A1 * | 8/2019 | Lian | B21J 15/36 |
| 2019/0351477 | A1 * | 11/2019 | Yabuguchi | B21J 15/045 |
| 2020/0139424 | A1 * | 5/2020 | Yabuguchi | B21J 15/26 |
| 2021/0379646 | A1 | 12/2021 | Killen | |
| 2021/0394254 | A1 * | 12/2021 | Yabunaka | B21J 15/32 |
| 2023/0294162 | A1 * | 9/2023 | Yabuguchi | B21J 15/105 227/61 |
| 2024/0066587 | A1 | 2/2024 | Kadlecek et al. | |

FOREIGN PATENT DOCUMENTS

| | | | | |
|---|---|---|---|---|
| EP | 2855046 | B1 | 4/2018 | |
| EP | 2910321 | B1 | 10/2018 | |
| EP | 3530372 | A1 | 8/2019 | |
| EP | 3534039 | A1 * | 9/2019 | B21J 5/16 |
| EP | 3643425 | B1 | 1/2022 | |
| EP | 4331743 | A1 | 3/2024 | |
| WO | 2018235641 | A1 | 12/2018 | |
| WO | 2019049910 | A1 | 3/2019 | |

OTHER PUBLICATIONS

Extended European Search Report Dated Aug. 21, 2023 cited in corresponding EP Patent Application No. 22210651.0.
NF Office Action Dated Apr. 19, 2024, cited in corresponding U.S. Appl. No. 17/932,324.
European Search Report dated Oct. 30, 2025 cited in EP Patent Application No. 22210651.0.

* cited by examiner

POWER TOOL HAVING FASTENER GRIPPING PORTION POSITION TRACKING FUNCTIONALITY

CROSS-REFERENCE TO RELATED APPLICATIONS

This application is a continuation of U.S. patent application Ser. No. 17/932,324, filed Sep. 15, 2022, the disclosures of which is incorporated herein by reference in its entirety.

FIELD OF THE INVENTION

The present disclosure relates to a power tool having fastener gripping portion position tracking functionality.

BACKGROUND OF THE INVENTION

Some existing blind rivet setting tools comprise a plurality of sensors for determining the position of the jaw assembly such as in U.S. Pat. No. 8,109,123, however, depending on multiple sensors to monitor jaw assembly position increases likelihood of tool failure.

BRIEF SUMMARY OF THE INVENTION

According to the present invention there is provided a power tool comprising: a motor; a fastener gripping portion operatively coupled to the motor for causing movement of the fastener gripping portion between a home position and a retracted position to set a fastener; a home position sensor for generating output indicative that the fastener gripping portion has reached the home position during a reset stage of operation in which the fastener gripping portion is moved towards the home position; and a controller for receiving motor turn information indicative of the number of turns of the motor and for monitoring the position of the fastener gripping portion based on the motor turn information and the output generated by the home position sensor.

The controller may determine the fastener gripping portion has reached the home position during the reset stage of operation upon occurrence of the first to occur of the controller receiving the home position sensor output indicative that the fastener gripping portion has reached the home position or the number of motor turns determined during the reset stage of operation equaling the number of motor turns determined during movement of the fastener gripping portion to the retracted position.

During the reset stage of operation if the controller determines the fastener gripping portion has reached the home position based on output from the home position sensor the motor turn information stored in memory is reset.

The controller may determine that the fastener gripping portion has reached the retracted position when the number of motor turns determined during a fastener setting stage of operation reaches a predetermined maximum number of motor turns stored in memory, whereby in response the controller stops the fastener setting stage of operation.

The home position sensor may be a Hall sensor mounted in a fixed position within the tool which is configured to detect a magnet which is axially fixed relative to the fastener gripping portion. Optionally the Hall sensor generates a signal when exposed to magnetic flux from the magnet of one polarity but not when exposed to magnetic flux of the other polarity and the magnet is arranged so that as the magnet moves past the Hall sensor in use the Hall sensor generates a signal indicative that the fastener gripping portion has reached the home position during the reset stage of operation.

The controller may be configured to control the motor to move the fastener gripping portion to the home position if in response to receiving a tool actuation signal the controller determines that the fastener gripping portion is not at the home position.

The motor may be a brushless motor and control circuitry thereof may generate the motor turn information.

The power tool may further comprise at least one sensor for monitoring turns of the motor and for generating the motor turn information.

The fastener gripping portion may be a jaw assembly.

The power tool may be a blind rivet setting tool.

BRIEF DESCRIPTION OF THE DRAWINGS

Various aspects and embodiments of the invention will now be described by way of non-limiting example with reference to the accompanying drawings, in which.

DETAILED DESCRIPTION OF THE PREFERRED EMBODIMENT

Figure 1:
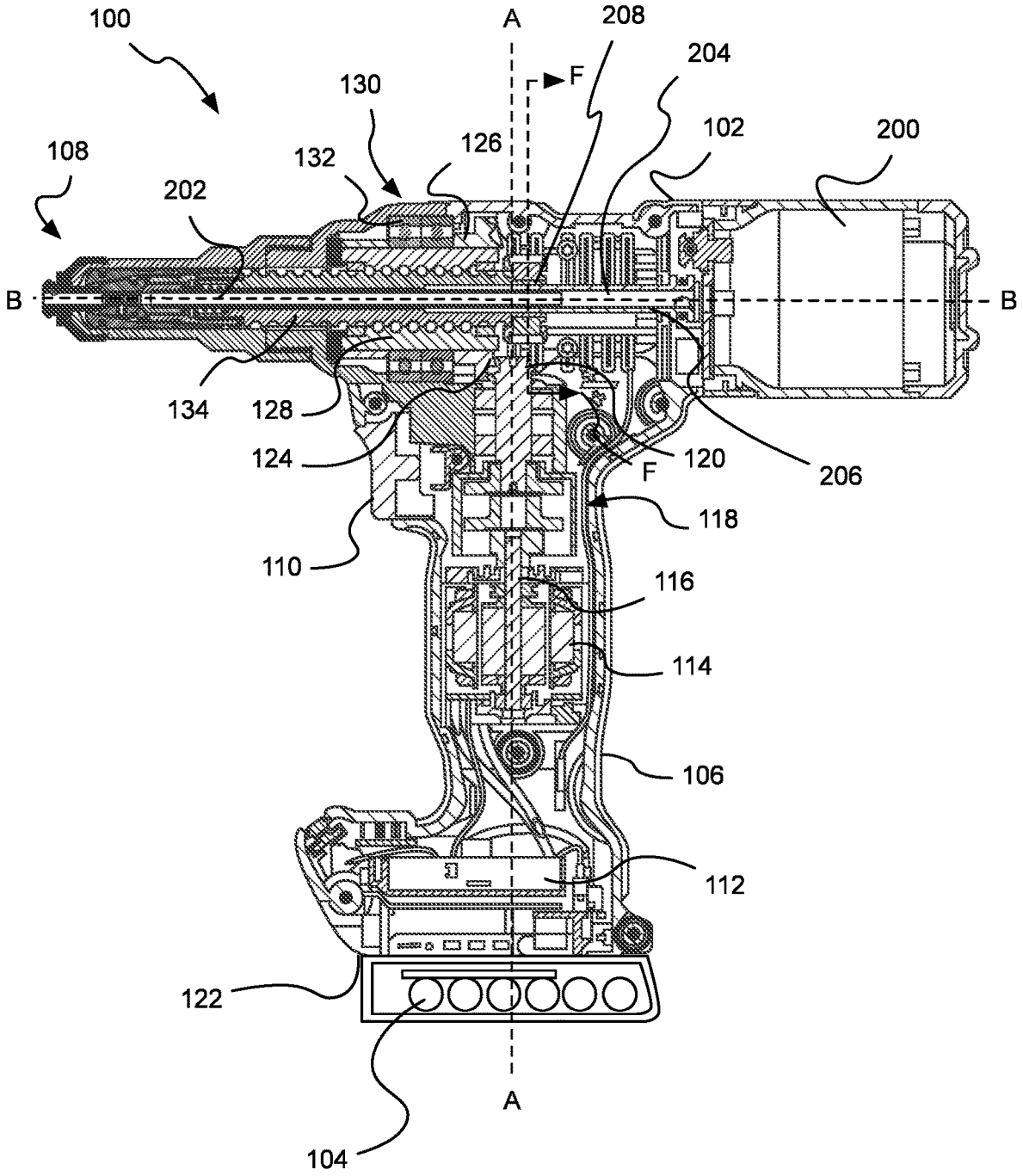
FIG. 1 shows a side cross-sectional view of a blind rivet setting tool.

FIG. 1 shows a side cross-sectional view of a blind rivet setting tool 100. The tool 100 has a housing 102 of a clam shell type construction having two halves which are fastened together. A battery 104 is releasably connected to the base 122 of the handle 106 via a battery attachment feature. To use the tool 100 a user inserts the mandrel of a blind rivet into a nose 108 of the tool 100 and pulls a trigger 110. In response to a controller 112 of the tool determining that the trigger 110 has been pulled the controller 112 generates a signal to activate a motor 114, which is a brushless motor. The motor 114 is located in the handle 106 and has a motor output shaft 116. Torque from the motor output shaft 116 is transferred via a transmission 118 to a first bevel gear 120. The transmission 118 comprises a series of planetary gear arrangements for reducing output speed while increasing torque. The first bevel gear 120 rotates at a lower speed than the motor output shaft 116 however with an increased torque relative to the motor output shaft 116. The motor output shaft 116, transmission 118 and first bevel gear 120 are aligned along a first axis A-A which extends along a longitudinal length of the handle 106. By also locating the battery 104 on the first longitudinal axis A-A weight distribution of the tool 100 is improved.

A second bevel gear 124 is provided on the end face of a driving sleeve 126. The driving sleeve 126 is rotationally fixed relative to an input sleeve 128 of a ball screw arrangement 130. The driving sleeve 126 and input sleeve 128 are fixed relative to each other due to a friction fit arrangement. An internal surface of the input sleeve 128 comprises a threaded surface. The outer surface of the driving sleeve 126 is supported by bearings 132 which enable rotation of the driving sleeve 126 with respect to the housing 102. A threaded rod 134 is mounted within the input sleeve 128, which extends through the input sleeve 128. A plurality of balls, such as metal ball bearings, ride in the opposing threaded surfaces of the input sleeve 128 and threaded rod 134, thereby defining a ball screw arrangement 130.

When the input sleeve 128 is rotatably driven by the driving sleeve 126 this causes axial movement of the threaded rod 134. In other words, torque from the motor 114 is transferred through the transmission 118, first and second bevel gears 120, 124 and driving sleeve 126 to the input sleeve 128, whereby rotation thereof causes axial movement of the threaded rod 134. The threaded rod 134 is configured to move along a second longitudinal axis B-B of the tool 100. The threaded rod 134 can move forwards or backwards along the axis B-B depending on the motor driving direction.

Figure 2:
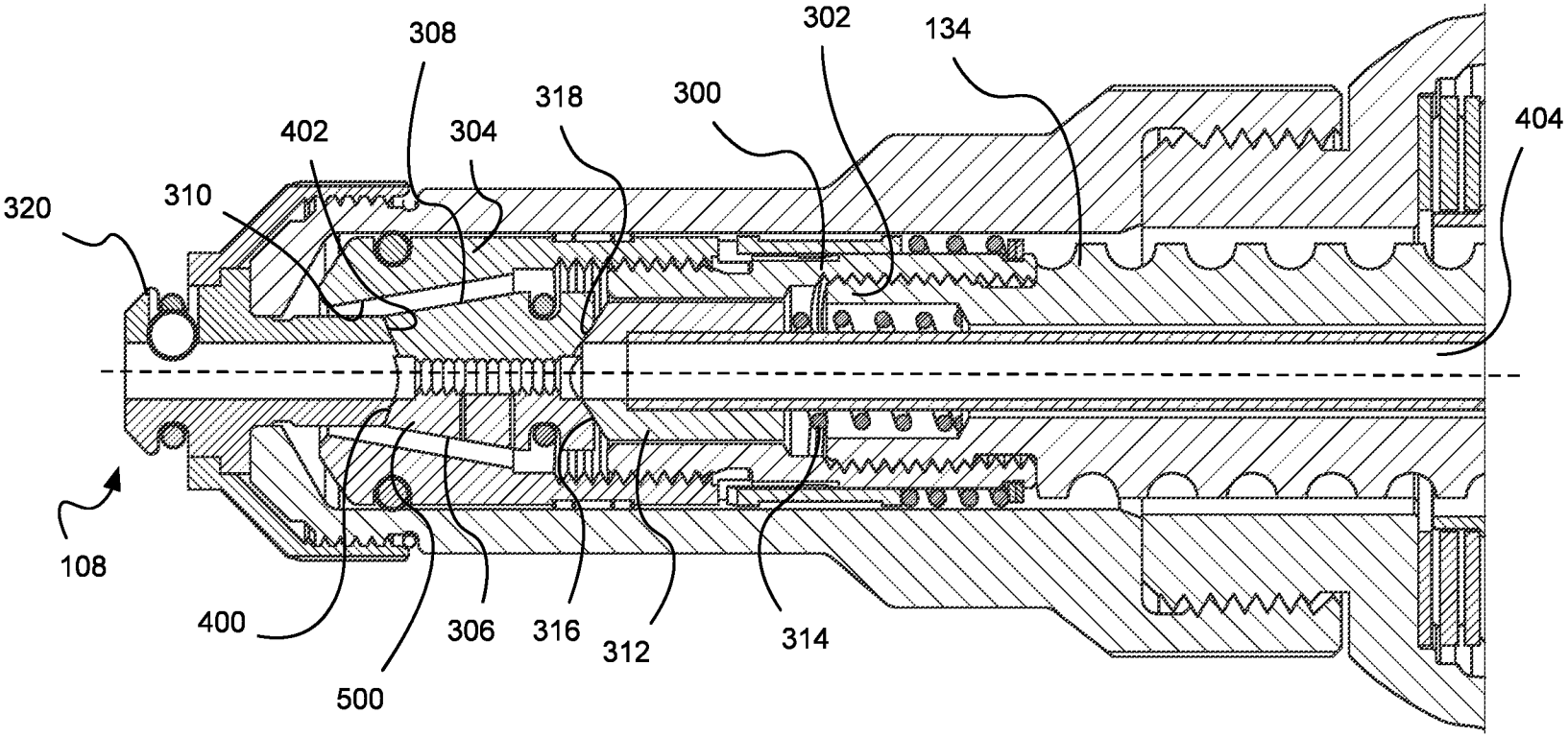
FIG. 2 shows a close-up of part of the blind rivet setting tool in FIG. 1.

Referring to FIG. 2 a connecting sleeve 300 is attached to a first end 302 of the threaded rod 134, which is mounted to the threaded rod 134 via a screw thread. A pull-back hull 304 is threadably attached to the connecting sleeve 300. Axial movement of the threaded rod 134 along the second longitudinal axis B-B therefore also causes axial movement of the pull-back hull 304.

A jaw assembly 500 is located within the pull-back hull 304. The jaw assembly (shown in FIG. 3*a*) has a plurality of circumferentially arranged jaws 306 each of which has a ramped outer surface 308 for cooperating with a conical inner surface 310 of the pull-back hull 304. A separator sleeve 312 is forced by a spring 314 against the jaws 306; more specifically a ramped front surface 316 of the separator sleeve 312 is forced against ramped rear surfaces 318 of the jaws 306. A nosepiece 320 is releasably attached at the opening to the nose 108 of the tool 100 which has an annular ramped surface 402. Each of the jaws 306 have a front ramped surface 400 for cooperating with the annular ramped surface 402 of the nose piece 320. Cooperation between the ramped outer surfaces 308 of the jaws 306 and the conical inner surface 310 of the pull-back hull 304, between the ramped rear surfaces 318 of the jaws 306 and the ramped front surface 316 of the separator sleeve 312 and between the front ramped surfaces 400 of the jaws and the annular ramped surface 402 of the nose piece 320 enables the tool 100 to set blind rivets in use.

Figure 3B:
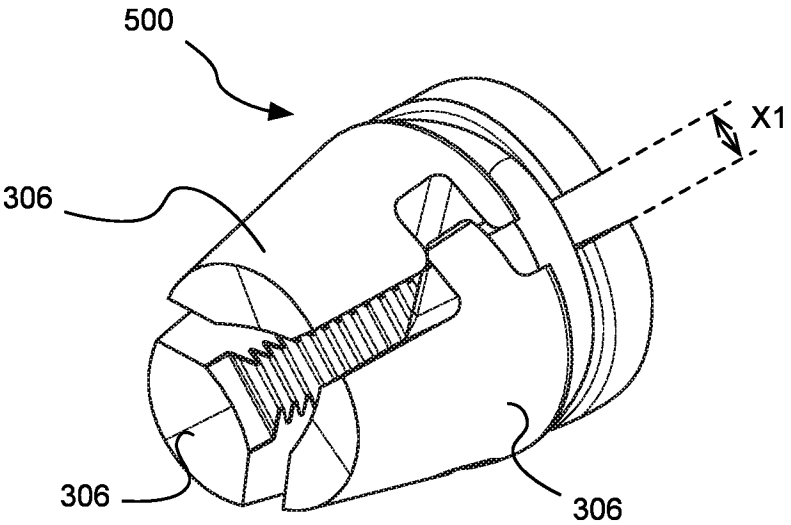
FIGS. 3*a* and 3*b* show a jaw assembly of the blind rivet setting tool in FIG. 1 in first and second configurations respectively.

To set a blind rivet a mandrel thereof is inserted through the nose piece 320 such that the mandrel extends between the jaws 306, thereby urging the jaws 306 radially apart (see FIG. 3*b*). Upon pulling the trigger 110 of the tool 100 the controller 112 causes the threaded rod 134, and thus the pull-back hull 304, to move along the second longitudinal axis B-B to the right in FIGS. 1 and 2. As the pull-back hull 304 is retracted its conical inner surface 310 is forced against the outer surfaces 308 of the jaws 306, whereby a component of force draws the jaws 306 backwards with the pull-back hull 304 whereas another component of force urges the jaws 306 radially inwards thereby clamping the mandrel of the blind rivet being set between the jaws 306.

In other words, pulling the pull-back hull 304 to the right in FIGS. 1 and 2 causes the jaws 306 to grip and pull the mandrel of a rivet being set. The blind rivet thus is pulled against the nose piece 320 for deforming the blind rivet and when the mandrel of the blind rivet is pulled far enough for setting the blind rivet the mandrel snaps.

Subsequently the tool 100 is required to perform a reset operation to dispose of the broken mandrel and to accept a fresh blind rivet for setting. During a reset operation of the tool 100 the controller 112 causes the motor 114 to reverse its direction for moving the threaded rod 134, and thus the pull-back hull 304, in the other direction along the second longitudinal axis B-B to the left in FIGS. 1 and 2. When the pull-back hull 304 has been moved sufficiently far to the left the spring 314 via the separator sleeve 312 will urge the front ramped surfaces 400 of the jaws 306 against the annular ramped surface 402 of the nose piece 320. Further movement of the threaded rod 134 to the left in FIGS. 1 and 2 will increase the pressure of the spring 314 against the separator sleeve 312 and thus cause the front ramped surfaces 400 of the jaws 306 to ride along the annular ramped surface 402 of the nose piece 320 while the ramped rear surfaces 318 of the jaws 306 ride along the ramped front surface 316 of the separator sleeve 312. This causes the jaws 306 to move radially outwards and release the grip on the snapped mandrel, whereby with reference to FIG. 1 the released snapped mandrel can be caused to fall under gravity along an internal path 204 in the direction of a collection chamber 200. For example, after a rivet setting operation, the user tilts the tool 100 such that the snapped mandrel moves into the collection chamber 200. The internal path 204 is defined by aligned openings extending through components between the jaws 306 and the collection chamber 200, including a first channel 202 extending through the threaded rod 134 along the second longitudinal axis B-B and a second channel 204 through a guidance sleeve 206.

Figure 3A:
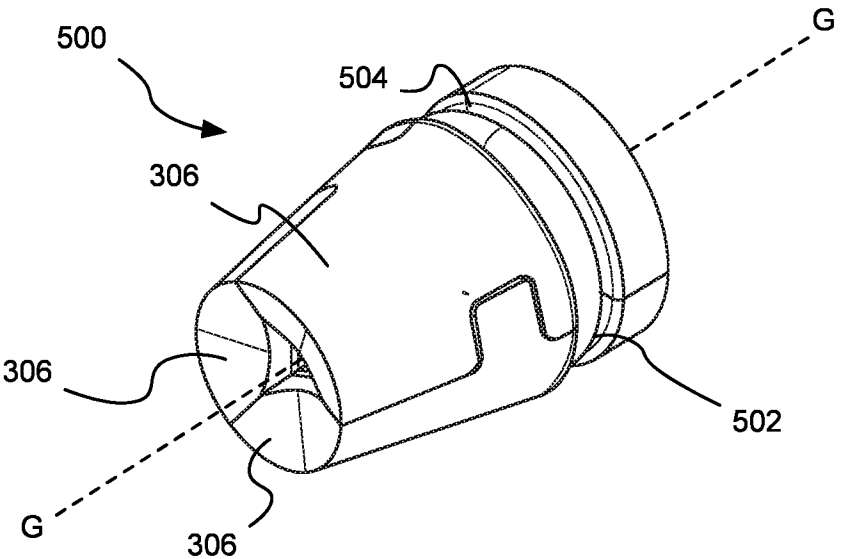

Turning to FIGS. 3*a* and 3*b* the jaw assembly 500 will now be discussed in more detail. FIG. 3*a* shows a perspective view of the jaw assembly 500 in a first configuration in which the jaws 306 are located radially as close to each other as possible. FIG. 3*b* shows a perspective view of the jaw assembly 500 in a second configuration in which the jaws 306 are urged radially apart from each other such as by a mandrel of a blind rivet being inserted through the space between the jaws 306 or the jaws 306 being forced against the annular ramped surface 402 of the nose piece 320. The jaw assembly 500 comprises three identical jaws 306 circumferentially arranged about a jaw assembly axis G-G. When the jaw assembly 500 is mounted in the tool 100, the jaw assembly axis G-G is coaxial with the second longitudinal axis B-B of the tool 100. The three jaws 306 can move radially with respect to the jaw assembly axis G-G.

There are situations during which the jaw assembly 500 is removed from the tool, in particular during routine maintenance of the tool 100 during which it is disassembled and then reassembled after being cleaned. Alternatively, the jaw assembly 500 may be swapped with a new jaw assembly because the jaws 306 of the original jaw assembly have worn. Further alternatively the jaw assembly 500 may be swapped with a new jaw assembly because the different jaw assemblies are configured for use with different sized mandrels. Referring again to FIGS. 3*a* and 3*b* the jaw assembly has a flexible o-ring 502 for holding the jaws 306 of the jaw assembly 500 together when it is not located within the tool 100. Each of the jaws 306 defines part of an annual groove 504 when the jaws 306 are in the configuration shown in FIG. 3*a* wherein the o-ring 502 is located in the annular groove 504 and biases the jaws 306 together. The o-ring 502 can be made from an elastic material such as rubber.

Figure 6:
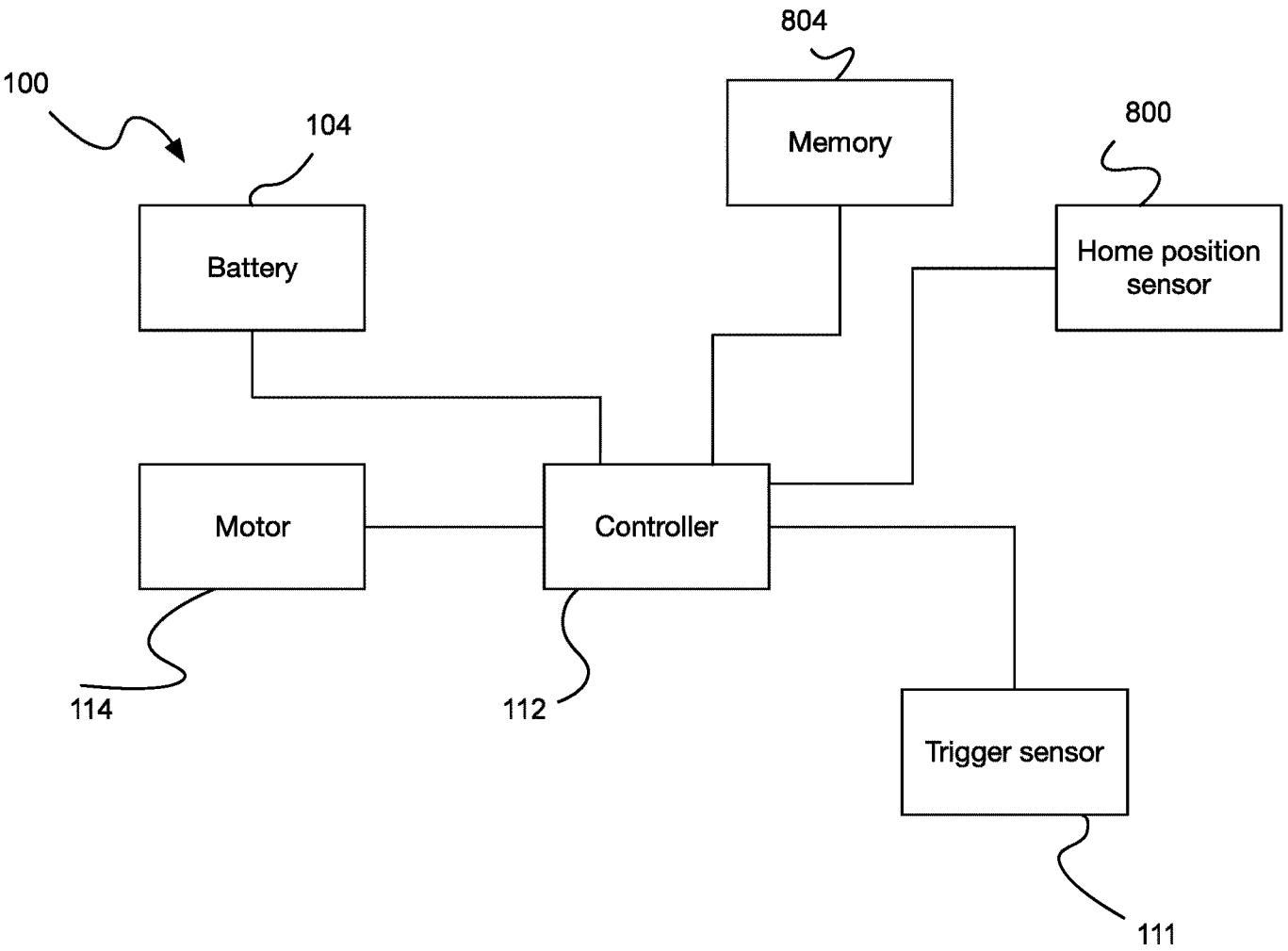
FIG. 6 shows a schematic drawing of the blind rivet setting tool in FIG. 1.

The controller 112 will be discussed in more detail with reference to FIG. 6 which shows a schematic diagram of the tool 100. The controller 112 is connected to the motor 114 and the battery 104. The controller 112 is configured to selectively control the motor 114 based on an actuation signal received from a trigger sensor 111 which is configured to generate a signal indicative that the trigger 110 has been pulled or released and a jaw assembly home position sensor 800.

A problem with some blind rivet setting tools which calculate the position of the jaw assembly 500 is that the calculated position of the jaw assembly 500 can drift over time due to cumulative inaccuracies. Some tools address this by including a clutch mechanism for protecting components of the tool if the jaw assembly 500 overshoots its intended range of movement during tool use.

The tool 100 advantageously does not need a clutch mechanism because the controller 112 can determine the absolute position of the jaw assembly 500 with respect to the housing 102 every fastening operation. This means that after each fastening operation inaccuracies in the jaw assembly 500 position calculation performed by the controller 112 are reset to zero.

The jaw assembly home position sensor 800 is configured to generate a signal indicative that the jaw assembly 500 is at the home position, which is the position in which the tool 100 is ready to receive a new blind rivet for setting. Based on information received from the jaw assembly home position sensor 800 the controller 112 determines that the jaw assembly 500 is at the home position irrespective of other position data the controller 112 receives or calculates regarding the jaw assembly 500.

Figure 5A:
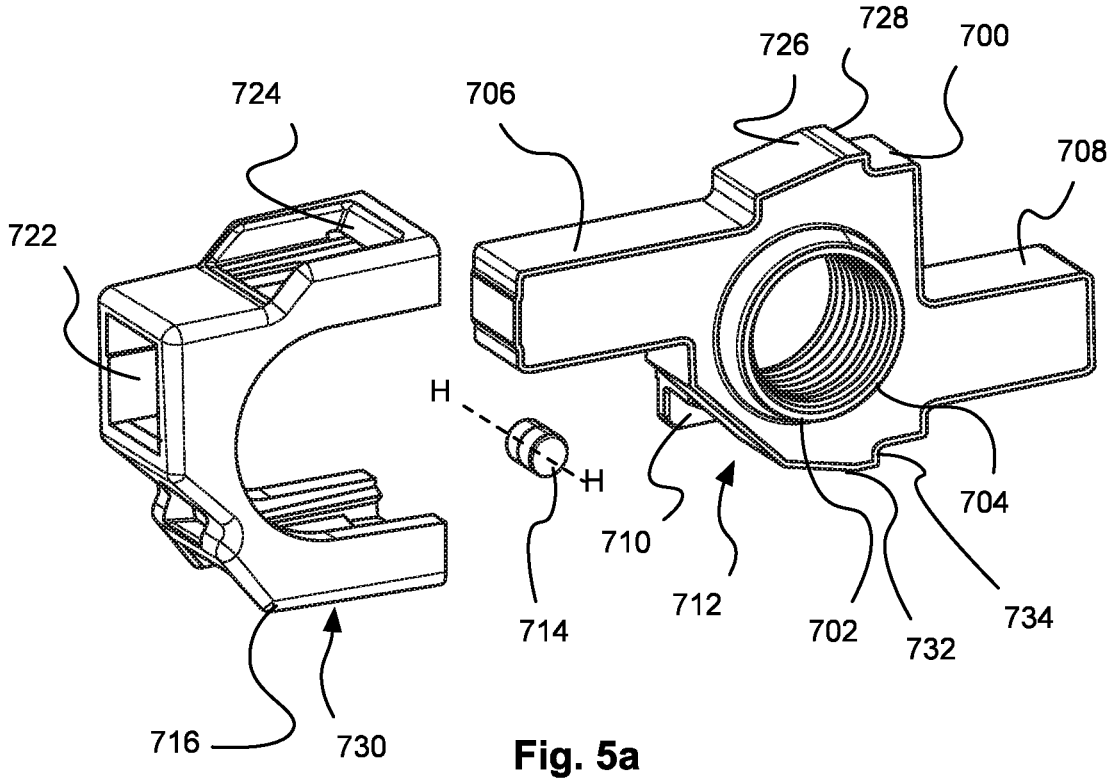
FIG. 5*a* shows an exploded view of a component of the blind rivet setting tool in FIG. 1.
Figure 5B:
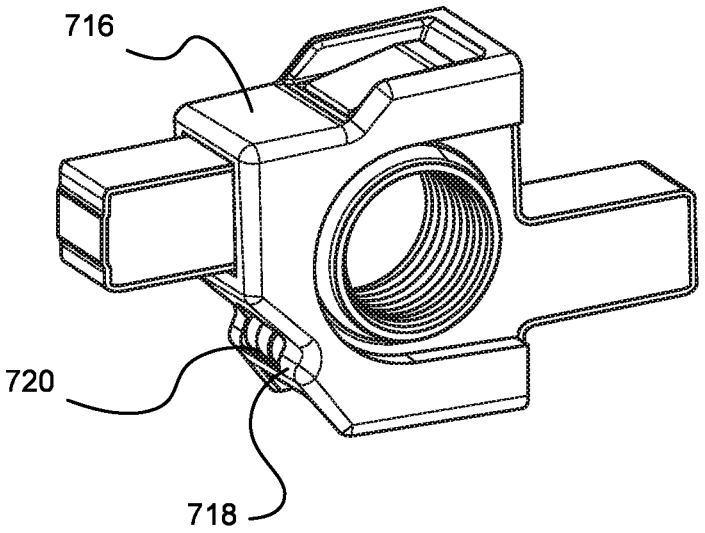
FIG. 5*b* shows the component in FIG. 5*a* in assembled form.

With reference to FIGS. 5*a* and 5*b* an anti-rotation bar 700 is engaged with the threaded rod 134 in a manner whereby the anti-rotation bar 700 is axially and rotationally fixed to the threaded rod 134. As the input sleeve 128 is rotated the anti-rotation bar 700 cooperates with the threaded rod 134 and slots 600, 602 in the housing 102 for causing the threaded rod 134 to move axially along the axis B-B. Since the anti-rotation bar 700 is rotationally fixed with respect to the housing 102 it slides relative to the housing 102 through the slots 600, 602 during axial movement of the threaded rod 134.

The anti-rotation bar 700 comprises a central hole 702 with a threaded inner surface 704 which is tightly threadably engaged with a reciprocal threaded surface 208 at an end of the threaded rod 134.

The anti-rotation bar 700 comprises a first arm 706 and a second arm 708. The first and second arms 706, 708 are mounted in first and second slots 600, 602 in the housing 102. When the threaded rod 134 moves along the second longitudinal axis B-B, the first and second arms 706, 708 slide along the first and second slots 600, 602. The first and second slots 600, 602 extend along longitudinal axes which are parallel to the second longitudinal axis B-B.

The anti-rotation bar 700 has a mounting plate 710 projecting from a central portion 712 of the anti-rotation bar 700. A magnet 714 is mounted to the mounting plate 710. A sleeve housing 716 is mounted over the anti-rotation bar 700 as shown in FIG. 5*b*.

The sleeve housing 716 comprises a magnet pocket 718 for receiving the magnet 714 and the sleeve housing 716 ensures that the magnet 714 does not move with respect to the anti-rotation bar 700 when mounted to the anti-rotation bar 700 as shown in FIG. 5*b*. The magnet pocket 718 comprises a window 720 exposing a portion of the magnet 714. This means that the sleeve housing 716 is not positioned between the magnet 714 and a Hall sensor comprising the home position sensor 800 (hereafter referred to as Hall sensor 800). Accordingly, the sleeve housing 716 itself does not attenuate the magnetic field generated from the magnet 714 in the direction of the Hall sensor 800 when the jaw assembly 500 is in the home position.

The sleeve housing 716 comprises an arm window 722 configured to receive the first arm 706. When the sleeve housing 716 is mounted on the anti-rotation bar 700, the first arm 706 projects through the arm window 722. The sleeve housing 716 comprises a snap-fit mechanism 724 for engaging a locking ramp 726 and snapping against a locking shoulder portion 728 of the anti-rotation bar 700. This securely engages the sleeve housing 716 against the anti-rotation bar 700. The sleeving housing 716 comprises a similar lower snap-fit mechanism 730 configured to engage a lower locking ramp 732 and snapping against a lower locking shoulder portion 734 of the anti-rotation bar 700.

Figure 4:
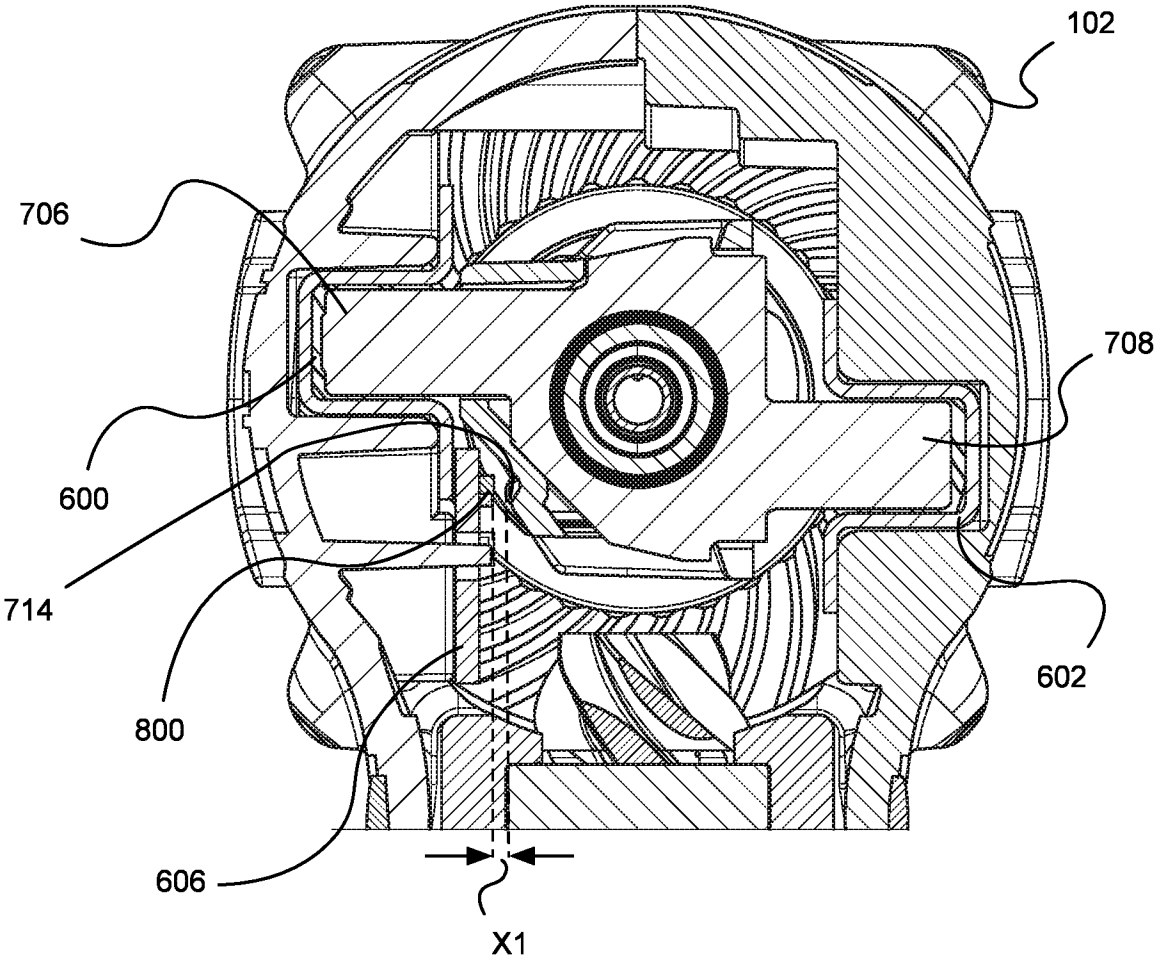
FIG. 4 shows a cross-sectional view of the blind rivet setting tool in FIG. 1 along the direction F-F.

Looking at FIG. 4 the tool 100 comprises a printed circuit board (PCB) 606 comprising the Hall sensor 800. The Hall sensor 800 is configured to detect the magnet 714 when the jaw assembly 500 is in the home position. The Hall sensor 800 and the magnet 714 are arranged to be close to each other when the jaw assembly 500 is in the home position. In some examples, the minimum distance X1 between the Hall sensor 800 and the magnet 714 is 1.1 mm. It has been noted that this minimum distance allows for sufficient sensitivity in the Hall sensor 800 detecting relative movement of the magnet 714 with respect to the Hall sensor 800. At the same time this allows sufficient clearance between the first and second arms 706, 708 and the first and second slots 600, 602 to allow slidable movement of the first and second arms 706, 708 in the first and second slots 600, 602.

As mentioned above, the anti-rotation bar 700 is axially and rotationally fixed relative to the threaded rod 134 and is rotationally fixed with respect to the housing 102. Given that the jaw assembly 500 is caused to move axially upon axial movement of the threaded rod 134 this means that the anti-rotation bar 700, the magnet 714, the threaded rod 134 and the jaw assembly 500 move together along the second longitudinal axis B-B in use. Detecting movement of the magnet 714 thus allows movement of the jaw assembly 500 to be detected.

The Hall sensor 800 is configured to detect a specific magnetic pole. In other words, the Hall sensor 800 is configured to detect magnetic flux of one polarity while being blind to magnetic flux of the other polarity, meaning the Hall sensor 800 generates a signal in response to detection of a specific pole of the magnet 714. For example the Hall sensor 800 is configured to detect magnetic flux emanating from the north pole of the magnet 714 while being blind to magnetic flux emanating from the south pole of the magnet 714, meaning the Hall sensor 800 generates a signal in response to detection of the North pole of the magnet 714. The tool 100 is configured such that the middle portion of the magnet 714—the transition between north and south magnetic poles—is aligned with the Hall sensor 800 when the jaw assembly 500 is in the home position. That is, upon occurrence of a change in polarity of the magnetic flux to which the Hall sensor 800 is exposed then the Hall sensor 800 generates a signal which is indicative of the jaw assembly 500 being in the home position.

This can be used to detect when the jaw assembly 500 has reached its home position during a reset operation of the tool 100. Continuing with the example in which the Hall sensor 800 is configured to detect magnetic flux emanating from the north pole of the magnet 714 only while being blind to magnetic flux emanating from the south pole of the magnet 714: the magnet 714 may be aligned such that during a rivet setting operation when the jaw assembly 500 is retracted and the magnet 714 moves away from the Hall sensor 800 the Hall sensor 800 is only exposed to magnetic flux emanating from the south pole of the magnet 714 meaning no signal is generated by the Hall sensor 800. During a reset operation of the tool as the jaw assembly 500 is moved towards the home position, and the magnet 714 is moved towards the Hall sensor 800, the Hall sensor 800 is exposed to magnetic flux emanating from the south pole of the magnet 714 meaning no signal is generated by the Hall sensor 800. However, after the jaws 500 have reached the home position and continue to move beyond the home position, the magnet moves past the Hall sensor 800 such that the Hall sensor 800 is only exposed to magnetic flux emanating from the north pole of the magnet 714 meaning a signal is suddenly generated by the Hall sensor 800. The controller 112 can use this signal to determine that the reset operation is complete.

As shown in FIG. 5*a*, the magnet 714 comprises a magnetic axis H-H which extends in a direction between opposite poles of the magnet 714 and the magnetic axis H-H is parallel with the second longitudinal axis B-B of the tool 100 along which the jaw assembly 500 moves from the home position to a retracted position during a rivet setting operation. In some examples the heretofore described arrangement is configured to detect variations in position of the magnet 714 as low as 0.6 mm, which means the jaw assembly 500 can be determined to have reached the home position to an accuracy of 0.6 mm.

Figure 7:
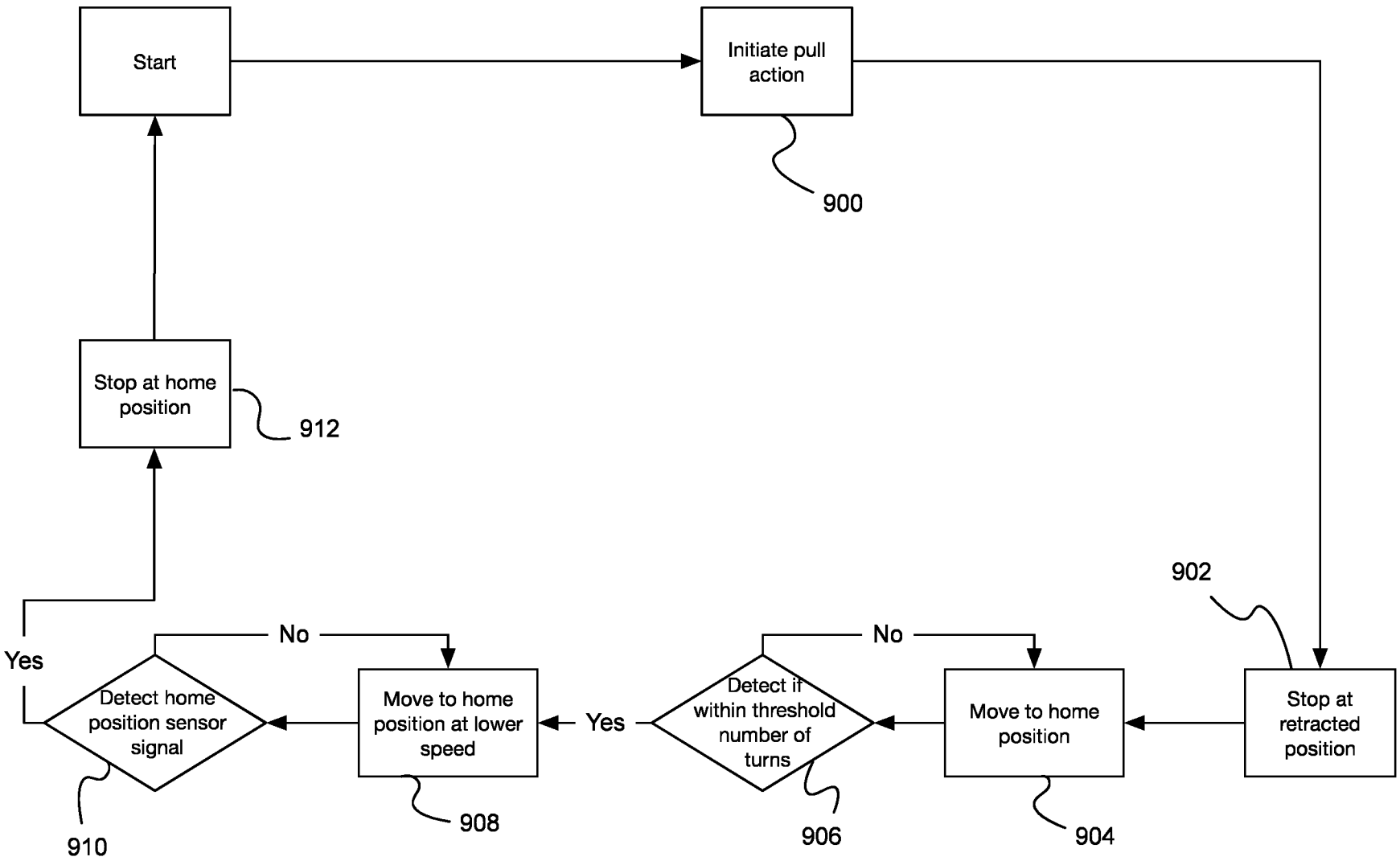
FIG. 7 shows a flow diagram showing the operation of the blind rivet setting tool in FIG. 1 according to a first example.

Operation of the tool 100 will now be discussed in more detail with respect to FIGS. 7, 8 and 9. FIG. 7 shows a simplified mode of operation of the tool 100. The functionality illustrated in FIG. 7 is implemented by the controller 112 on the basis of software stored in memory 804, whereby upon the controller 112 running such software it implements the functionality illustrated in FIG. 7. The controller 112 is configured to control the tool 100 based on a signal received from the Hall sensor 800 and motor status information.

Based on input from the trigger sensor 111 the controller 112 initiates a pull action operation (otherwise referred to as a rivet setting operation) as shown in step 900 of FIG. 7. The jaw assembly 500 is in the home position when the controller 112 starts the pull action operation. The controller 112 starts the pull action operation 900 by issuing a control instruction to the motor 114 at time T=T1 whereby the motor 114 is caused to ramp up in speed to a predetermined target speed which is attained at time T2 shown in FIG. 9. In some examples the predetermined target speed is the maximum driving speed of the motor. In some examples the predetermined target speed may fall in the range between 24,000 RPM to 30,000 RPM. By configuring the tool 100 so that the predetermined target speed of the motor 114 between T1 and T2 is the maximum driving speed of the motor this provides that the jaw assembly 500 moves from the home position to the retracted position as quickly as possible. It will however be appreciated that in practice the maximum driving speed of the motor 114 is dependent on various factors such as the level of charge of the battery 104, the temperature of the battery 104, the magnitude of force required to deform the rivet being set and the magnitude of friction experienced by internal features of the tool 100 in use.

The controller 112 issues another control instruction to stop the motor 114 when the threaded rod 134 and the jaw assembly 500 are in the retracted position as shown in step 902, wherein how this is determined is explained below. In response the motor 114 brakes at t=T3 and stops at t=T4; preferably between t=T3 and t=T4 the motor 114 is braked at the maximum achievable deceleration rate. The retracted position corresponds with the maximum distance which the tool 100 is configured to enable the jaw assembly 500 to be retracted.

The controller 112 is configured to determine the position of the threaded rod 134 and thereby the jaw assembly 500 based on motor status information such as the number of turns (or partial turns) the motor 114 has made since initiation of the pull action operation in step 900 when the jaw assembly 500 was in the home position. Deriving the position of a jaw assembly in a blind rivet setting tool based on motor turns is a known technique, described for example in EP3530372A1 and EP3530370A1 the contents of which are incorporated herein by reference.

The controller 112 is configured to receive information indicative of the motor status information from the motor 114 e.g. information indicative of the number of motor turns performed. Alternatively, the controller 112 can optionally determine the number of motor turns based on information received from the motor 114 upon implementing software functionality stored in memory 804.

The controller 112 determines that the jaw assembly 500 is in the retracted position when the number of motor turns since initiation of the pull action operation in step 900 reaches a predetermined maximum value stored in the memory 804. This means that the controller 112 is configured to determine the position of the threaded rod 134 and thus the jaw assembly 500 when moving towards the retracted position away from the home position based on motor status information alone.

Figure 9:
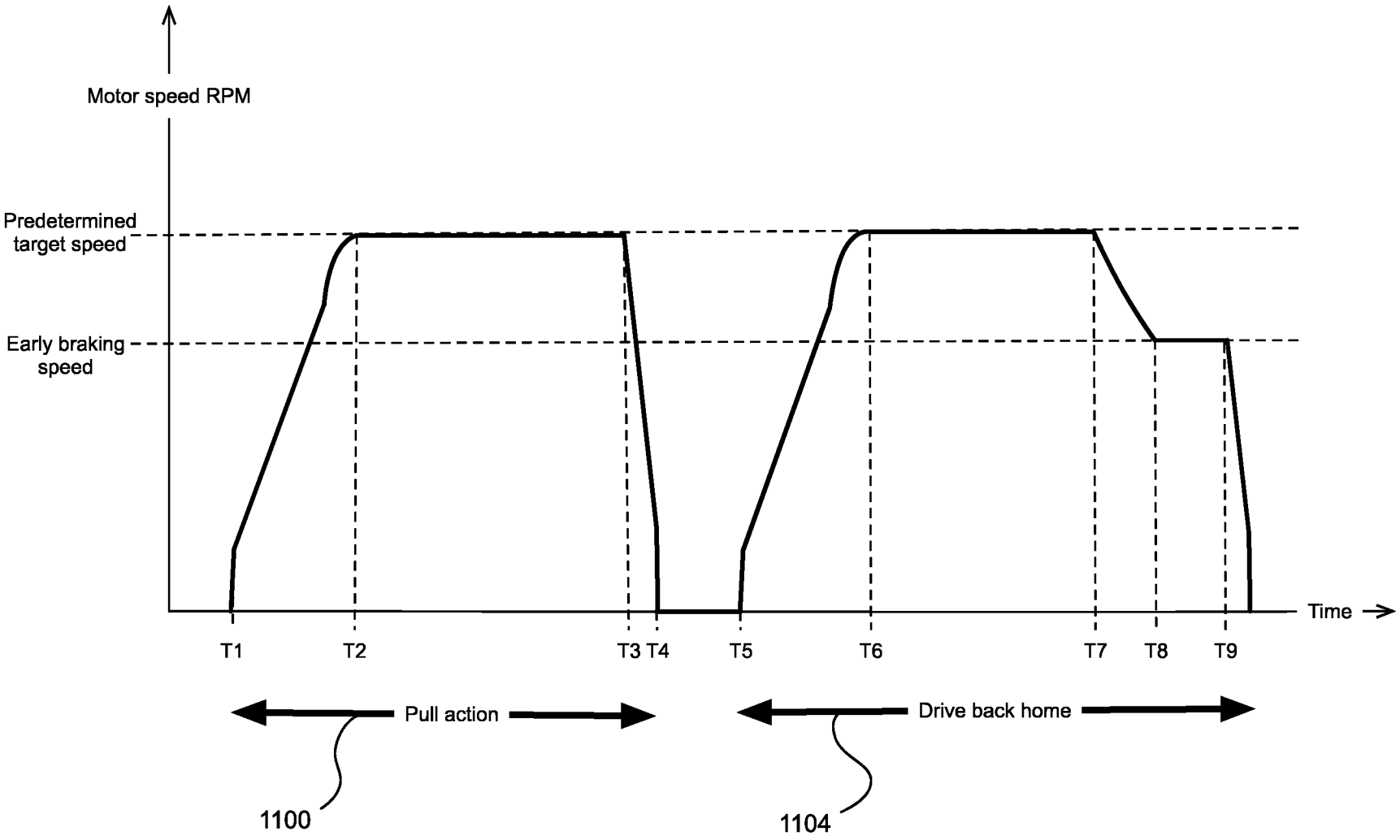
FIG. 9 shows a graph of motor speed versus time of the blind rivet setting tool in use.

The tool 100 then needs to perform a drive back home operation 1104 (as shown in FIG. 9), alternatively referred to as a reset operation, in order to move the jaw assembly 500 back to the home position in order to release the snapped mandrel of the blind rivet being set and to be ready to receive a mandrel of a subsequent blind rivet to be set. To enact the reset operation the controller 112 issues a control instruction to the motor 114 to drive in a reverse direction and thereby move the jaw assembly 500 towards the home position as shown in step 904. In response to the controller 112 issuing this instruction at T=T5 the motor 114 is caused to ramp up in speed (in a reverse direction) to the predetermined target speed which is attained at t=T6. As a reminder, in some examples the predetermined target speed is the maximum driving speed of the motor 114 so that the jaw assembly 500 moves from the retracted position towards the home position as quickly as possible; again though as mentioned previously the maximum driving speed of the motor 114 which is achievable in practice is dependent on various factors such as the level of charge of the battery 104, the temperature of the battery 104 and the magnitude of friction experienced by internal features of the tool 100 in use.

In order to protect the tool 100 the controller 112 does not drive the motor 114 at the predetermined target speed through the entire distance that the jaw assembly 500 moves from the retracted position to the home position. Instead, the controller 112 is configured to cause the motor 114 to drive in reverse direction at a reduced speed when the jaw assembly 500 is determined by the controller 112 to be within a threshold distance of the home position, which will be described in more detail later.

During reverse driving of the motor 114 in step 906 of FIG. 7 the controller 112 compares the number of motor turns occurring during reverse movement with the number of motor turns which occurred during the pull action operation. When the number of motor turns determined to have occurred during reverse movement is within a threshold amount of the number of motor turns which occurred during the pull action operation the controller 112 in step 908 causes the motor driving speed in the reverse direction to be reduced so that the jaw assembly 500 can be more precisely positioned in the home position to reduce the extent to which the jaw assembly 500 overshoots the home position. The threshold amount is realised in step 906 when the number of motor turns determined to have occurred during reverse movement is within 25% of the number of motor turns which occurred during the pull action operation. In other words, the threshold condition of step 906 is realised when the jaw assembly 500 has been driven 75% of the way back towards its home position. If during reverse driving of the motor 114 in step 906 the controller 112 determines that the threshold condition has not been satisfied the motor 114 is caused to continue driving in reverse at the predetermined target speed wherein step 906 is repeated.

In some embodiments the distance of travel of the jaw assembly 500 from the home position to the maximum stroke pull back position is 25 mm. Thus, during a return operation, the threshold condition of step 906 is determined to have been satisfied when the jaw assembly has been returned 75% of the way back towards its home position, namely when the jaw assembly is within 6.25 mm of the home position.

In some embodiments the distance of travel of the jaw assembly 500 from the home position to the maximum stroke pull back position is 30 mm. Thus, during a return operation, the threshold condition of step 906 is determined to have been satisfied when the jaw assembly has been returned 75% of the way back towards its home position, namely when the jaw assembly is within 7.5 mm of the home position.

Returning to FIG. 9, in response to the controller 112 in step 908 issuing a control instruction to slow the motor 114 down at time T7 the motor 114 decelerates to a predetermined early braking speed which is lower than the predetermined target speed of the motor 114 between times T2 to T3 and T6 to T7. In this way, the controller 112 provides early braking to the motor 114 before the jaw assembly 500 reaches the home position.

In embodiments in which the predetermined motor target speed between times T2 to T3 and T6 to T7 ranges between 24,000 RPM to 30,000 RPM the predetermined early braking speed ranges between 15,000 RM to 20,000 RPM. More specifically in an embodiment in which the target motor driving speed between T2 to T3 and T6 to T7 is 24,000 RPM the early braking speed is 15,000 RPM. In another embodiment in which the target motor driving speed between T2 to T3 and T6 to T7 is 30,000 RPM the early braking speed is 20,000 RPM.

The rate of deceleration between times T7 and T8 when the motor 114 reaches the predetermined early braking speed is such that the early braking speed is achieved before the jaw assembly 500 reaches the home position, wherein the rate of deceleration between T7 and T8 can be the maximum achievable deceleration rate although there is freedom to use a less steep rate of deceleration provided that the early braking speed is achieved before the jaw assembly 500 reaches the home position. When the early braking speed has been achieved at time t=T8 the controller 112 controls the motor 114 to keep driving at that speed until the controller 112 detects input from the Hall sensor 800 in step 910 which is indicative that the jaw assembly 500 has reached the home position as heretofore described. In response the controller 112 issues in step 912 at t=T9 a stop instruction to stop the motor 114 completely whereby the motor 114 decelerates (preferably at the maximum achievable deceleration rate) until the motor 114 stops turning.

When the controller 112 receives the signal from the Hall sensor 800 in step 910 the controller 112 is configured to reset the motor status information to correspond with the jaw assembly 500 being in the home position. For example, the controller 112 resets the active number of motor turns to zero. This means that any drift between the active number of motor turns determined by the controller 112 and the actual number of motor turns is reset to zero each time the tool 100 is operated.

This means that the controller 112 is configured to determine the position of the jaw assembly 500, and thereby control the operating speed of the motor 114, when the jaw assembly 500 is moving towards the home position away from the retracted position based on the motor status information and a signal received from the Hall sensor 800.

The jaw assembly 500 has now returned to the home position and the tool 100 is ready to accept a new blind rivet.

As already mentioned, the maximum driving speed of the motor 114 which is achievable in practice is dependent on multiple factors such as the level of charge of the battery 104, the temperature of the battery 104, the magnitude of force required to deform the particular rivet being set and the magnitude of friction experienced by internal features of the tool 100 in use. In tools in which a jaw assembly is driven backwards during a reset operation at maximum speed all the way until the home position is detected and a complete stop of the motor is initiated the level of overshoot passed the home position is variable based on the multiple factors effecting the maximum driving speed of the motor. Thus, when such tools are designed, they need to have high tolerances built into the design to accommodate the variable extents which the jaw assembly may overshoot the home position. The heretofore described early braking functionality addresses this issue. The early braking speed is chosen to be lower than the maximum driving speed of the motor and so is less effected by the factors mentioned above such as battery charge level, meaning that the tool 100 can more reliably control the motor 114 to operate at a specific predetermined early braking speed. By causing the motor 114 to have slowed down to the early braking speed by the time when the jaw assembly 500 reaches the home position means that when the home position is finally reached, and the jaw assembly 500 is braked hard, the jaw assembly 500 is always braking from the same speed regardless of tool operating conditions (e.g. ambient temperature/battery charge level) and so the level of overshoot past the home position is more predictable meaning the tool 100 can be controlled within tighter operational tolerances, whereby the tolerances required to be built into the tool design are less.

In view of the foregoing paragraph, it will be appreciated that there is some freedom for a designer to select a suitable percentage change reduction in motor speed during a reset stage of operation between the predetermined target speed and the early braking speed. If the early braking speed is very low this will of course reduce the potential level of overshoot of the jaw assembly 500 past the home position, however, the overall duration of the reset operation will be increased. On the other hand, if the early braking speed is much closer to the predetermined target speed this will reduce the overall duration of the reset operation but will increase the potential level of overshoot of the jaw assembly 500 past the home position. Some balance must therefore be struck in selecting a suitable percentage change reduction in motor speed during a reset stage of operation between the predetermined target speed and the early braking speed, which maintains the potential level of overshoot of the jaw assembly 500 past the home position within acceptable levels while maintaining a reasonable overall duration of the reset operation. With this in mind, it is envisaged that in some embodiments during a reset stage of operation the early braking speed can range between 50% to 80% of the predetermined target speed. In some embodiments during a reset stage of operation the early braking speed can range between 60% to 70% of the predetermined target speed. In some embodiments during a reset stage of operation the early braking speed can be range between 62% to 67% of the predetermined target speed.

Another example will now be discussed with reference to FIG. 8 which is identical to FIG. 7 except that the operation of the tool 100 comprises additional functionality which will now be described. The functionality illustrated in FIG. 8 is implemented by the controller 112 on the basis of software stored in memory 804, whereby upon the controller 112 running such software it implements the functionality illustrated in FIG. 8

The controller 112 is configured to actuate the tool 100 in response to receiving an actuation signal from the trigger sensor 111 in step 1000. The controller 112 then determines that the user wishes to use the tool 100 and in response determines whether the jaw assembly 500 is in the home position in step 1002. The controller 112 can determine whether the jaw assembly 500 is in the home position similarly to before, namely based on whether a signal is generated by the Hall sensor 800. If in step 1002 the controller 112 determines that a signal is generated by the Hall sensor 800 then the jaw assembly 500 is determined to be in the home position and in response the controller 112 proceeds to step 900 and initiates the pull action of step 900 as before.

Conversely if in step 1002 the controller 112 determines that a signal is not generated by the Hall sensor 800 then the jaw assembly 500 is determined not to be in the home position. This may be the case if power was removed before the tool 100 could finish performing a reset operation 1104. In response to the controller 112 making a negative determination in step 1002 it issues a control instruction to drive the motor 114 in reverse at a low speed in step 908 until in step 910 the controller 112 detects a signal generated by the Hall sensor 800 indicative that the jaw assembly 500 is in the home position; the low reverse driving speed of the motor 114 is lower than the aforementioned target driving speed between T2 to T3 and T6 to T7 discussed in connection with FIG. 9.

In some embodiments in which the target motor driving speed between T2 to T3 and T6 to T7 ranges between 24,000 to 30,000 RPM the low reverse driving speed ranges between 15,000 to 20,000 RPM. More specifically in an embodiment in which the target motor driving speed between T2 to T3 and T6 to T7 is 24,000 RPM the low reverse driving speed is 15,000 RPM. In another embodiment in which the target motor driving speed between T2 to T3 and T6 to T7 is 30,000 RPM the low reverse driving speed is 20,000 RPM.

In response to the controller 112 receiving a positive determination in step 910 subsequently the controller 112 in step 912 stops reverse driving of the motor 114 (preferably at the maximum achievable deceleration rate), whereby the jaw assembly 500 is now in the home position. The user then depresses the trigger 110 again and the tool repeats steps 1000, 1002 and then proceeds to step 900 to initiate the pull action.

Once the pull action has been initiated in step 900, the controller 112 determines the displacement of the jaw assembly 500 from the home position in the manner already described based on counting motor turns. If the controller 112 determines in step 1004 that the number of motor turns during the rivet setting stage of operation has reached a predetermined maximum number of motor turns stored in memory 804 (whereby the jaw assembly 500 is in the maximum pull back stroke position) the controller 112 stops the motor 114 in step 902 as before.

If the controller 112 makes a negative determination in step 1004 the controller 112 continues the pull action and then determines in step 1006 whether the number of motor turns during the rivet setting stage of operation has reached a predetermined minimum number of motor turns stored in memory 804.

If in step 1006 the controller 112 makes a negative determination the controller 112 continues the pull action.

If in step 1006 the controller 112 makes a positive determination the controller 112 then determines in step 1008 whether the trigger 110 is deactivated based on input from the trigger sensor 111.

If in step 1008 the controller 112 makes a negative determination, then the controller 112 continues the pull action in step 900. However, if in step 1008 the controller 112 makes a positive determination the controller 112 stops the motor 114 in step 902 as before.

Figure 8:
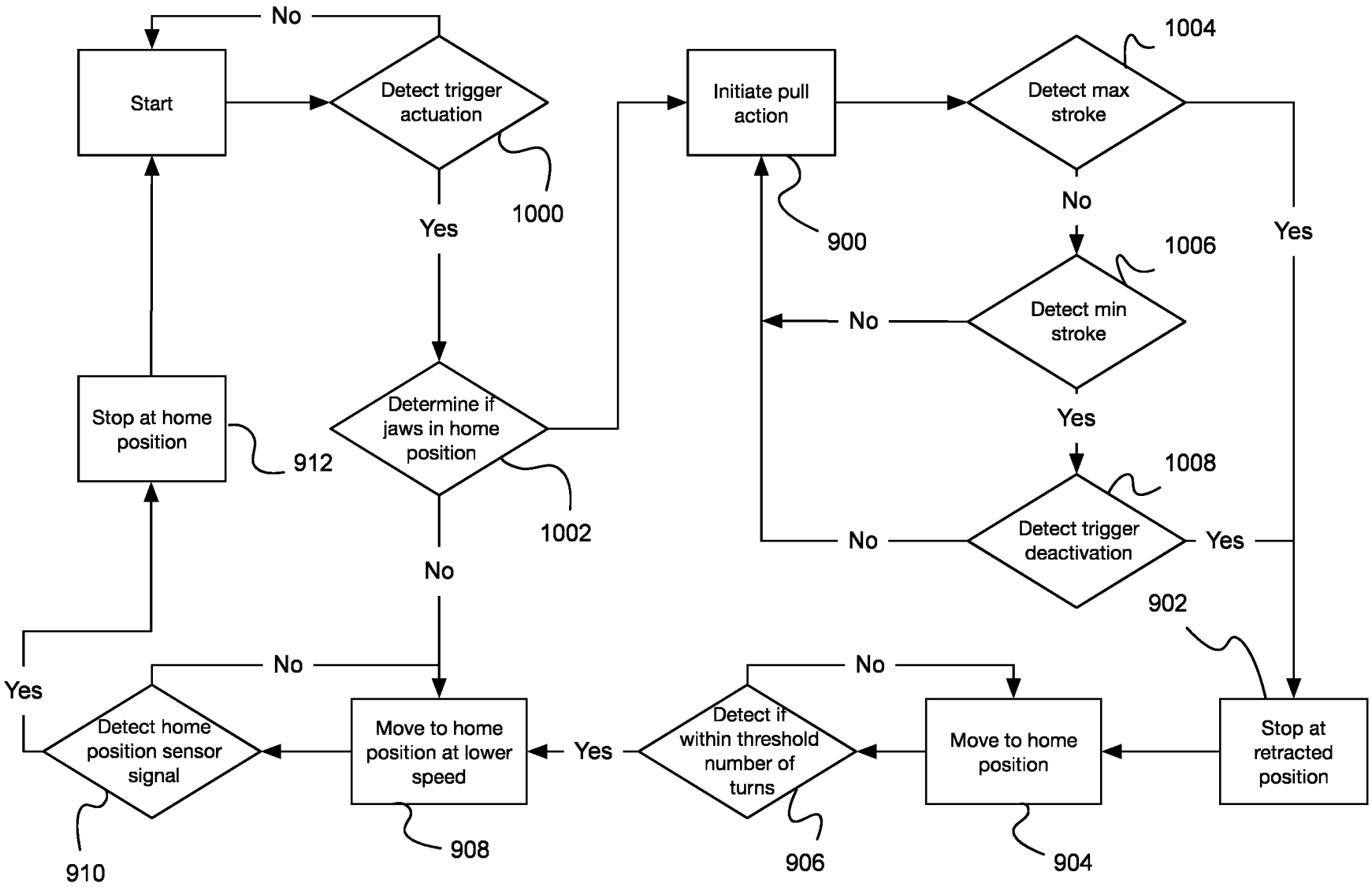
FIG. 8 shows a flow diagram showing the operation of the blind rivet setting tool in FIG. 1 according to a second example.

Subsequently steps 902 to 912 in FIG. 8 are implemented in a similar manner to the correspondingly numbered steps in FIG. 7 which have already been discussed.

It will be appreciated that whilst various aspects and embodiments have heretofore been described the scope of the present invention is not limited thereto and instead extends to encompass all arrangements, and modifications and alterations thereto, which fall within the spirit and scope of the appended claims.

For instance, whilst illustrative embodiments have been described as employing software it will be appreciated by persons skilled in the art that the functionality provided by such software may instead be provided by hardware (for example by one or more application specific integrated circuits), or indeed by a mix of hardware and software.

In some examples the battery 104 is removable from the tool 100 or alternatively the battery 104 is integral to the tool 100. Alternatively, or additionally the tool 100 may comprise other power sources e.g. it may be configured to receive power from a mains power supply.

As shown in FIG. 1, the driving sleeve 126 and input sleeve 128 are fixed to each other due to a friction fit arrangement. Alternatively, the driving sleeve 126 and input sleeve 128 can be fixed via an interlocking arrangement such as a spline fit arrangement or other male and female interlocking-type arrangement.

As shown in FIG. 3*a*, the o-ring 502 is seated in a groove 504. In some alternative examples the o-ring 502 may be replaced with any suitable means to keep the jaws 306 together such as a c-clip, a circlip, an e clip, a snap ring, or another spring fastener.

The o-ring 502 is made from an elastic material such as rubber. In other examples, the o-ring 502 is optionally made from polyurethane, PTFE, ethylene propylene rubber, neoprene, nitrile, or silicone.

As shown in FIG. 3*a* the jaw assembly 500 comprises three jaws 306. However, in alternative examples, the jaw assembly 500 can comprise any number of jaws 306 more than two.

In some examples the jaws 306 do not interlock with each other for maintaining jaw alignment.

As shown in FIGS. 3*a* and 3*b* the jaws 306 are identical. This makes manufacture simpler because a single tooling can be used to create multiple jaws 306.

In general, the functionality described in connection with FIGS. 7 and 8 may be implemented in hardware or special purpose circuits, software, logic, or any combination thereof. For example some aspects may be implemented in hardware while other aspects may be implemented in firmware or software which may be executed by the controller 112, microprocessor or other computing device although the disclosure is not limited thereto. While various aspects of the disclosure may be illustrated and described as block diagrams, flow charts, or using some other pictorial representation, it is well understood that these blocks, apparatus, systems, techniques or methods described herein may be implemented in, as non-limiting examples, hardware, software, firmware, special purpose circuits or logic, general purpose hardware or by the controller 112 or other computing devices or some combination thereof.

The examples of this disclosure may be implemented by computer software executable by a data processor or by hardware or by a combination of software and hardware. The data processing may be provided by means of one or more data processors. Further in this regard it should be noted that any blocks of the logic flow as in the Figures may represent program steps, or interconnected logic circuits, blocks and functions, or a combination of program steps and logic circuits, blocks and functions.

The memory 804 may be of any type suitable to the local technical environment and may be implemented using any suitable data storage technology, such as semiconductor based memory devices, magnetic memory devices and systems, optical memory devices and systems, fixed memory, and removable memory. Also, the controller 112 may be of any type suitable to the local technical environment, and may include one or more of general purpose microprocessors, digital signal processors (DSPs) or processors based on multi core processor architecture as non-limiting examples.

Some examples of the disclosure may be implemented as a chipset, in other words a series of integrated circuits communicating among each other. The chipset may comprise microprocessors arranged to run code, application specific integrated circuits (ASICs), or programmable digital signal processors for performing the operations described above.

As already described in connection with step 906 the threshold amount is realised when the number of motor turns determined to have occurred during reverse movement is within 25% of the number of motor turns which occurred during the pull action operation. However there is flexibility in the specific distance implemented in practice provided the same overall functionality is achieved, for instance in some embodiments the threshold amount is realised in step 906 when the number of motor turns determined to have occurred during reverse movement is reaches a specific percentage of the number of motor turns which occurred during the pull action operation ranging between 5% to 25% (optionally between 10% to 15%) of the number of motor turns which occurred during the pull action operation.

As shown in FIG. 5*a*, the anti-rotation bar 700 optionally comprises the mounting plate 710 projecting from the central portion 712 of the anti-rotation bar 700 for receiving the magnet 714. In some other examples, the magnet 714 is mounted to the central portion 712 (or any other part of the anti-rotation bar 700) in a recess in the central portion 712. The magnet 714 is optionally mounted to the anti-rotation bar 700 (whether in a recess or on the mounting plate 710) using glue or the attractive magnetic force of the magnet 714 against the ferrous anti-rotation bar 700.

As shown in FIG. 5*a*, the anti-rotation bar 700 optionally comprises the sleeve housing 716 configured to secure the magnet 714 against the anti-rotation bar 700. In some other examples, the sleeve housing 716 is not provided.

It will be appreciated that the specific shape of the anti-rotation bar 700 and position of the slots 600, 602 can be adapted, provided that the anti-rotation bar 700 achieves the purpose of guiding axial movement of the threaded rod 134. Moreover, the specific location of the magnet 714 on the anti-rotation bar 700 and the way in which the magnet 714 is attached to the anti-rotation bar 700 may be adapted provided that the controller 112 is still able to determine when jaw assembly 500 is in the home position based on interaction between the magnet 714 and Hall sensor 800.

Whilst FIGS. 4, 5*a*, 5*b* disclose an example for mounting the magnet 714 on the anti-rotational bar 700, in alternative embodiments the magnet 714 can be mounted to another component which moves together with the threaded rod 134 during operation of the tool 100, wherein the position of the Hall sensor 800 is correspondingly adapted.

FIG. 4 shows a Hall sensor 800 which is mounted on a PCB 606 and configured to detect the relative movement of the magnet 714 with respect to the Hall sensor 800. In alternative embodiments the Hall sensor 800 can be replaced with an alternative sensor configured to detect when the jaw assembly 500 is in the home position. For example, instead of a Hall sensor 800 the home position sensor can be a switch e.g. a microswitch which is actuated by interacting with the anti-rotation bar 700 (or a feature attached thereto) when the jaw assembly 500 is in the home position. In other words, in such embodiments when the jaw assembly 500 is in the home position the switch is actuated by the anti-rotation bar 700 and generates output indicative that the jaw assembly 500 is in the home position whereby in response the controller 112 implements step 912. In other embodiments instead of a Hall sensor 800 the home position sensor can be replaced by an optical sensor configured to detect the presence or absence of a reference indicator on the threaded rod 134 or the anti-rotation bar 700 when the jaw assembly 500 is in the home position for indicating that the jaw assembly 500 is in the home position. In other words, in such embodiments when the jaw assembly 500 is in the home position the optical sensor generates output indicative that the jaw assembly 500 is in the home position whereby in response the controller 112 implements step 912.

In some embodiments the tool 100 can be configured to detect the occurrence of a mandrel snapping such as by monitoring current usage by the motor 114. During a pull back stage of operation as the jaw assembly 500 pulls the mandrel of a rivet more tightly the current draw of the motor will increase and then suddenly decrease when the mandrel snaps. The controller 112 can monitor for such a sudden drop in current and in response to detecting such occurrence determine that the mandrel of the rivet being set has snapped and thus initiate step 902 to stop the jaw assembly 500. Subsequently the controller 112 initiates the reset stage of operation either automatically or in response to release of the trigger 110.

In other embodiments the tool 100 can be configured to detect the occurrence of a mandrel snapping by monitoring motor speed. During a pull back stage of operation as the jaw assembly 500 pulls the mandrel of a rivet more tightly the speed of the motor 114 will decrease and then suddenly increase when the mandrel snaps. The controller 112 can monitor for such a sudden increase in motor speed and in response to detecting such occurrence determine that the mandrel of the rivet being set has snapped and thus initiate step 902 to stop the jaw assembly 500. Subsequently the controller 112 initiates the reset stage of operation either automatically or in response to release of the trigger 110.

Regardless of how the controller determines when it is time to implement step 902 and thus stop retraction of the jaw assembly 500 in use the controller 112 keeps track of the position of the jaw assembly 500 based on motor turns and output from a single sensor namely the home position sensor 800 as heretofore described.

The motor 114 has been described as being a brushless motor and the controller 112 cooperates with the brushless motor (in particular with its control electronics) in order to control the brushless motor and determine motor status information e.g. number of motor turns. In other embodiments however the motor 114 may be a brushed motor having a motor output shaft driven by a stator and having at least one magnet on the motor output shaft. For the controller 112 to determine motor turn information of such a brushed motor the tool 100 additionally has a motor sensor (not shown) for generating output indicative of motor turn information; such as a Hall sensor which cooperates with the at least one magnet on the motor output shaft and which generates output indicative of variations in magnetic flux density as the motor shaft rotates which can be used by the controller 112 to determine motor turn information e.g. number of motor turns. Since the concept of determining motor turn information in the context of brushed and brushless motors is already known, meaning that the aforementioned ways of determining motor turn information are not the only ways of doing so, there is freedom for a designer to select a way of determining motor turn information when designing a tool 100 which implements the invention described herein. Whether or not a brushless motor is used the controller 112 can determine the direction of rotation of the motor 114 based on whether the controller 112 is implementing a pull action 900 (in which case the motor 114 will be rotating in a first direction) or whether the controller is implementing a reset operation (in which case the motor 114 will be rotating in a second direction). It is here mentioned that in battery operated embodiments the motor 114 is configured to operate using DC current, whereas in mains operated embodiments the motor is configured to operate using AC current. Finally the heretofore described functionality need not necessarily be used exclusively in blind rivet setting tools but may be used in other power tools having a fastener gripping portion which moves backwards from a home position in order to set a fastener and which is then returned to the home position. For example the heretofore described functionality can be implemented in other tools such as rivet setting tools (not necessarily blind rivet fastening tools), swage fastener tools and lockbolt fastener tools wherein the fastener gripping portion of such tools is configured to grip the type of fastener which the tool is used to set e.g. the fastener gripping portion of a swage fastener tool is configured to grip a swage fastener.

What is claimed is:

1. A power tool comprising:

a handle including a trigger thereon;

a motor at least partially disposed within the handle for control by the trigger, the motor having a motor output shaft rotatable about a motor rotational axis to generate torque, the motor rotational axis extending along a longitudinal axis of the handle;

an internally threaded input sleeve configured for rotation about a translational axis that is perpendicular to the longitudinal axis of the handle;

a transmission including a first bevel gear operatively coupled to the motor for rotation about the longitudinal axis and a second bevel gear operatively coupled to the first bevel gear for rotation about the translational axis;

a threaded rod mounted within the input sleeve for axial movement along the translational axis between a home position and a retracted position;

a driving sleeve rotatably mounted on the input sleeve and operatively coupled to the second bevel gear to rotatably drive the input sleeve and cause the axial movement of the threaded rod along the translational axis, wherein the second bevel gear is arranged on the driving sleeve;

an anti-rotation member having an internally threaded hole for engagement with a threaded surface of the threaded rod in a manner that axially and rotationally fixes the anti-rotation member to the threaded rod, the anti-rotation member including a mounting plate projecting therefrom to receive and mount a magnet:

a home position sensor comprising a Hall sensor fixedly mounted in the power tool and configured to detect movement of the magnet and generate for generating an output signal indicative that a front end of the threaded rod has reached the home position during a reset stage of operation; and a controller operatively coupled to the motor and the home position sensor, the controller being configured to receive motor turn information indicative of the number of rotations of the motor output shaft and monitor a position of the front end of the threaded rod based on the motor turn information and the output signal generated by the home position sensor.

2. The power tool of claim 1, wherein the controller is configured to determine the front end of the threaded rod has reached the home position during the reset stage of operation upon occurrence of the first to occur of the controller receiving the home position sensor output signal indicative that the front end of the threaded rod has reached the home position, or the number of motor output shaft rotations determined during the reset stage of operation equaling the number of motor output shaft rotations determined during movement of the front end of the threaded rod to the retracted position.

3. The power tool of claim 2, wherein the controller is configured to reset motor turn information stored in memory upon the determination that the front end of the threaded rod has reached the home position based during the reset stage of operation.

4. The power tool of claim 1, wherein the controller is configured to:

determines that the front end of the threaded rod has reached the retracted position when the number of motor output shaft rotations determined during operation reaches a predetermined maximum number of motor output shaft rotations stored in memory, and control the motor to stop a fastener setting stage of operation in response to the determination that the front end of the threaded rod has reached the retracted position.

5. The power tool of claim 1, wherein:

the Hall sensor generates a signal when exposed to magnetic flux from the magnet of one polarity but not when exposed to magnetic flux of the another polarity, and the magnet is mounted on the mounting plate such that a middle portion of the magnet is aligned with the Hall sensor when the threaded rod is in the home position.

6. The power tool of claim 1, wherein the controller is configured to control the motor to move the front end of the threaded rod to the home position when, in response to receiving a tool actuation signal, the controller determines that the front end of the threaded rod is not at the home position.

7. The power tool of claim 1, wherein the motor is brushless motor and control circuitry thereof generates the motor turn information.

8. The power tool of claim 1, further comprising at least one sensor for monitoring motor output shaft rotations and generating the motor turn information.

9. The power tool of claim 1, wherein the front end of the threaded rod includes a fastener gripping jaw assembly.

10. The power tool of claim 1, wherein the power tool is a blind rivet setting tool.

11. The power tool of claim 1, wherein the front end of the threaded rod is threaded.

12. The power tool of claim 11, wherein a connector is connected to the threaded front end of the threaded rod.

13. The power tool of claim 12, wherein the connector is a sleeve which is connected via a threaded connection.

14. A power tool comprising:

a handle;

a motor, at least partially located within the handle, including a motor output shaft extending along a longitudinal axis of the handle to generate torque;

an internally threaded input sleeve configured for rotation about a translational axis that is perpendicular to the longitudinal axis of the handle;

a bevel gear arrangement including a first bevel gear operatively coupled to the motor for rotation about the longitudinal axis and a second bevel gear operatively coupled to the first bevel gear for rotation about the translational axis;

a threaded rod mounted within the input sleeve for axial movement along the translational axis between a home position and a retracted position;

a driving sleeve rotatably mounted on the input sleeve and operatively coupled to the second bevel gear to rotatably drive the input sleeve and cause the axial movement of the threaded rod along the translational axis, wherein the second bevel gear is arranged on the driving sleeve;

an anti-rotation member to receive the threaded rod in a manner that axially and rotationally fixes the anti-rotation member to the threaded rod, the anti-rotation member including a mounting plate projecting therefrom to receive and mount a magnet;

a sleeve housing arranged over the anti-rotation member, the sleeve housing having a magnet pocket to secure the magnet against the mounting plate;

a home position sensor comprising a Hall sensor fixedly mounted in the power tool and configured to detect movement of the magnet and generate a first output signal indicative that a front end of the threaded rod has reached the home position during a reset operation; and a controller operatively coupled to the motor and the home position sensor, the controller being configured to: receive the first output signal receive motor turn information indicative of the number of rotations of the motor output shaft, monitor an axial position of the threaded rod based on the motor turn information, and control the motor based on the first output signal, and the motor turn information.

15. The power tool of claim 14, wherein the controller is further configured to reset motor turn information stored in memory based on the determination that the front of the threaded rod has reached the home position.

16. The power tool of claim 14, wherein the controller is further configured to control the motor to move the threaded rod to the home position based on a determination that the threaded rod is not at the home position.

17. The power tool of claim 14, wherein the controller is further configured to cause the motor to drive in a reverse direction at a reduced speed upon determining that the threaded rod is within a threshold distance of the home position.

18. A power tool comprising:

a motor including a motor output shaft extending along a first axis of the power tool to generate torque;

an internally threaded input sleeve configured for rotation about a second axis of the power tool that is perpendicular to the first axis;

a threaded rod mounted within the input sleeve for axial movement along the second axis between a home position and a retracted position;

a driving sleeve rotatably mounted on the input sleeve to rotatably drive the input sleeve and cause the axial movement of the threaded rod along the second axis;

an anti-rotation member to receive the threaded rod, the anti-rotation member including a mounting plate projecting therefrom to receive and mount a magnet:

a sleeve housing arranged over the anti-rotation member, the sleeve housing having a magnet pocket to secure the magnet against the mounting plate, the magnet pocket having a window exposing a portion of the magnet when the sleeve housing is mounted on the anti-rotation member;

a home position sensor comprising a Hall sensor fixedly mounted in the power tool and configured to detect movement of the magnet and generate an output signal indicative that the front end of the threaded rod has reached the home position during a reset operation; and a controller operatively coupled to the motor and the home position sensor, the controller being configured to: receive the output signal and motor turn information indicative of the number of rotations of the motor output shaft, monitor an axial position of the threaded rod based on the motor turn information, and cause the motor to drive in a reverse direction at a reduced speed upon determining that the threaded rod is within a threshold distance of the home position.

19. The power tool of claim 18, wherein:

the anti-rotation member has a first arm and a second arm; and the sleeve housing has an arm window configured to receive the first arm when the sleeve housing is mounted on the anti-rotation member such that the first arm projects through the arm window.

20. The power tool of claim 18, wherein:

the anti-rotation member has an upper locking ramp, a lower locking ramp, an upper locking shoulder portion adjacent to the upper locking ramp, and a lower locking shoulder portion adjacent to the lower locking ramp; and the sleeve housing has an upper snap-fit mechanism configured to engage the upper locking ramp and the upper locking shoulder portion to engage the sleeve housing against the anti-rotation member at an upper region thereof, and a lower snap-fit mechanism configured to engage the lower locking ramp and the lower locking shoulder portion to engage the sleeve housing against the anti-rotation member at a lower region thereof.

* * * * *